United States Patent [19]

Timewell

[11] 4,334,445

[45] Jun. 15, 1982

[54] Z STYLE SPEED WRENCH

[75] Inventor: Richard R. Timewell, Seattle, Wash.

[73] Assignee: R. T. Tool Co. Ltd., Canada

[21] Appl. No.: 243,250

[22] Filed: Mar. 12, 1981

Related U.S. Application Data

[63] Continuation of Ser. No. 21,847, Mar. 19, 1979, abandoned.

[51] Int. Cl.[3] ..... B25B 13/00

[52] U.S. Cl. ..... 81/177 PP; 81/177.8; 81/60

[58] Field of Search ..... 81/60, 63, 177 R, 177 B, 81/177 ST, 177.8, 177.9, 177 E, 177 PP; 145/61 G, 61 C, 65, 77, 75

[56] References Cited

U.S. PATENT DOCUMENTS

| | | | |
|---|---|---|---|
| 1,431,389 | 10/1922 | Frisz | 81/177.9 |
| 2,182,673 | 12/1939 | Magnano | 81/177 ST |
| 2,524,508 | 10/1950 | Barnes | 81/177 PP |
| 3,824,881 | 7/1974 | Wright | 81/177 G |
| 4,102,375 | 7/1978 | Rossini | 81/177 A |

FOREIGN PATENT DOCUMENTS

| | | | |
|---|---|---|---|
| 743497 | 1/1933 | France | 81/177 B |

*Primary Examiner*—James L. Jones, Jr.
*Attorney, Agent, or Firm*—Cole, Jensen & Puntigam

[57] ABSTRACT

A wrench which includes an elongated shaft having a device at one end to receive a drive, such as a handle or the like, which drive usually is free to rotate on the elongated shaft, and a device at the other end to receive a socket or similar article. Alternatively, the other end may itself be configured in socket form or other tool, such as a phillips screwdriver head. The elongated shaft includes two swivel points along its length, permitting the tool to take various operating configurations, including straight through, an L form for high torque, and a lazy Z form for high speed.

3 Claims, 12 Drawing Figures

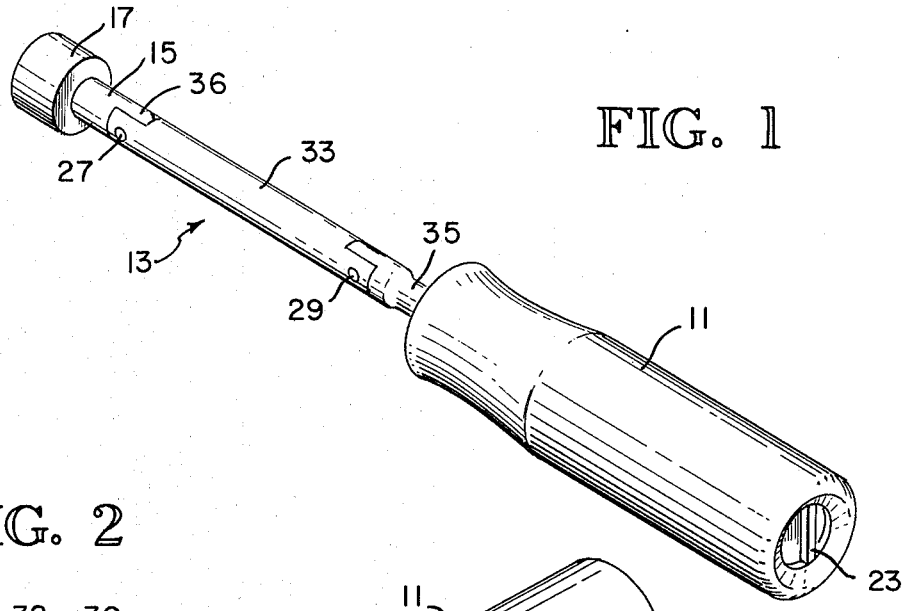
FIG. 1
FIG. 2
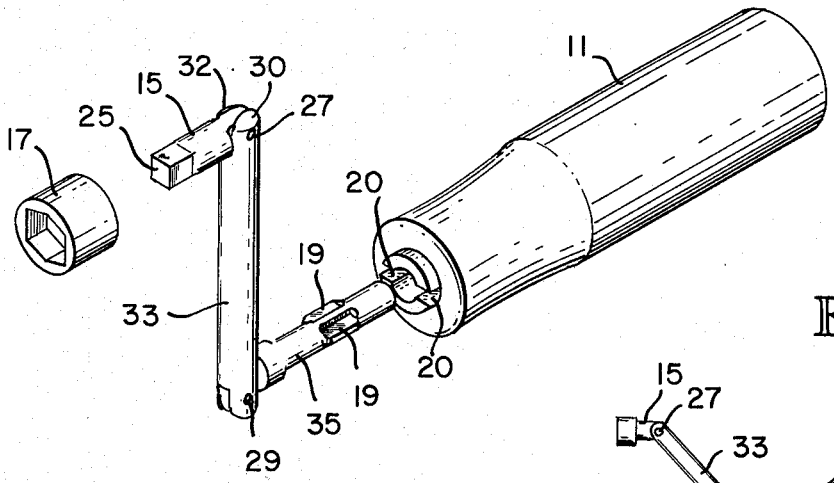
FIG. 4
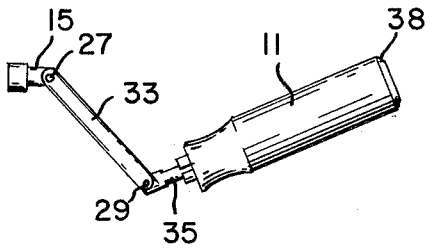
FIG. 3
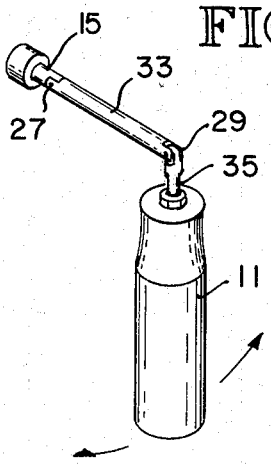
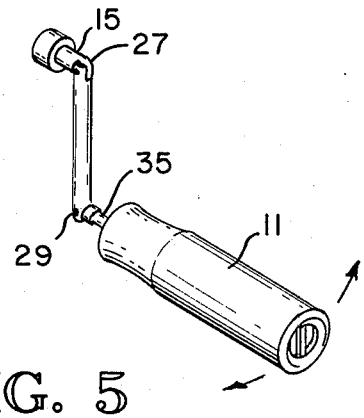
FIG. 5

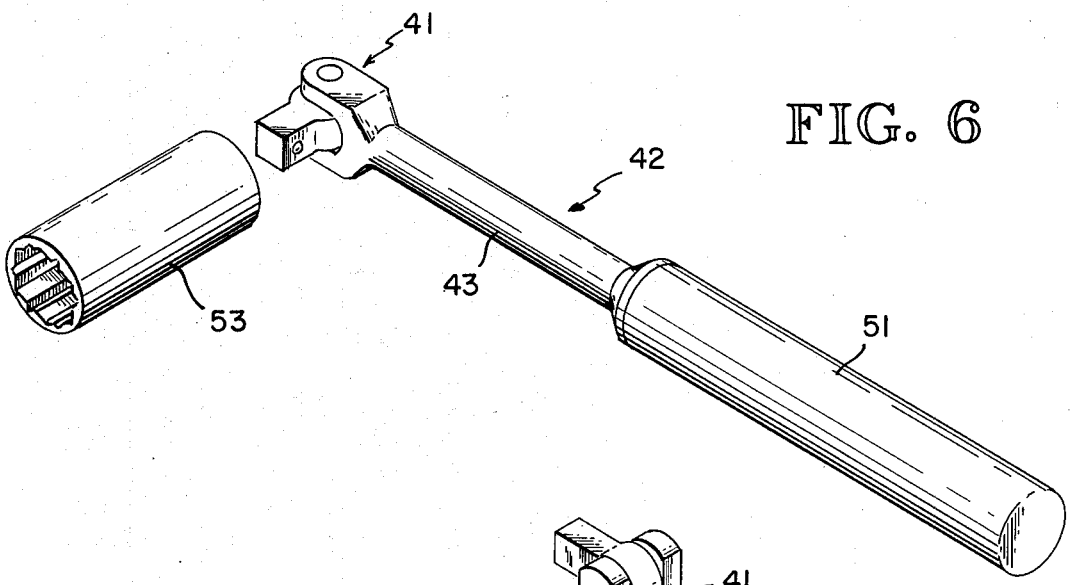
FIG. 6
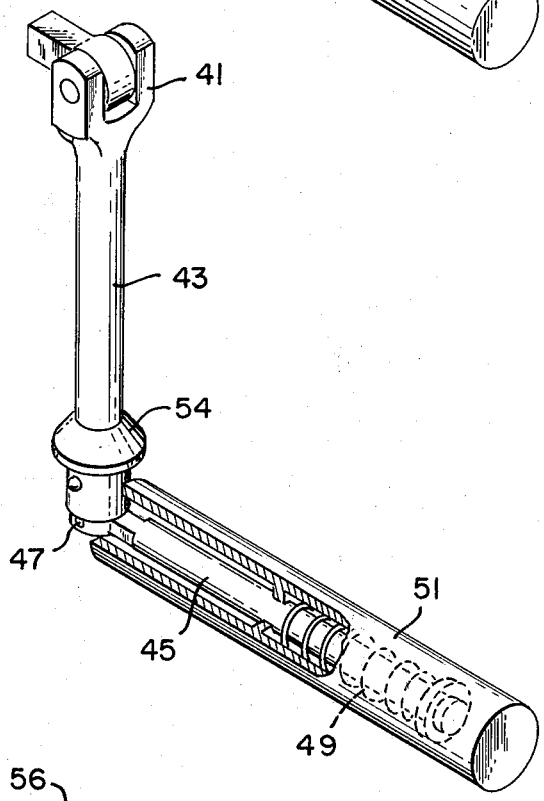
FIG. 7
FIG. 8
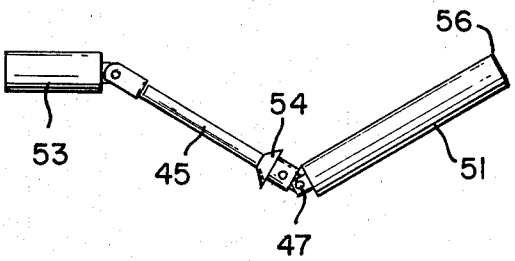

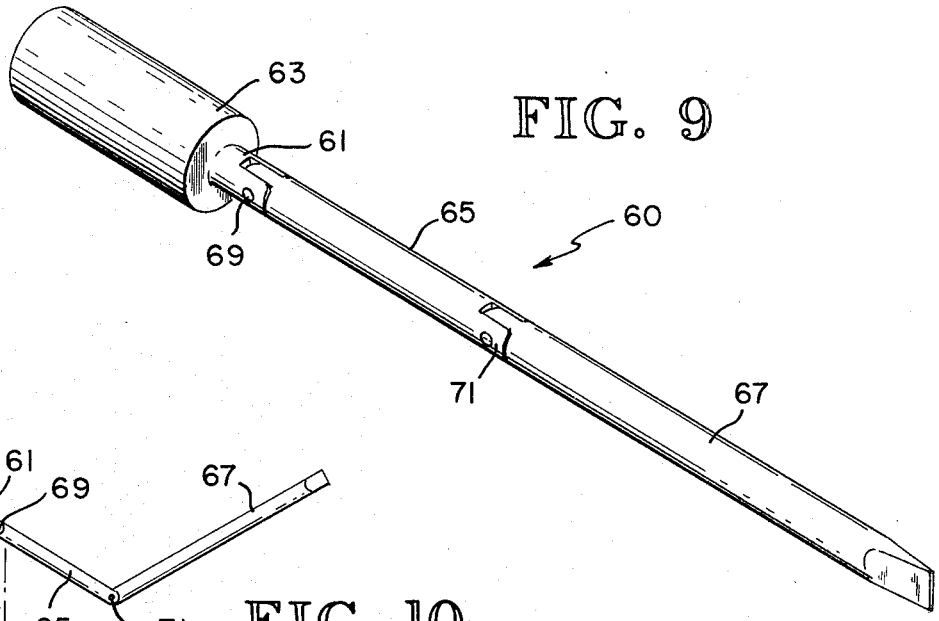
FIG. 9
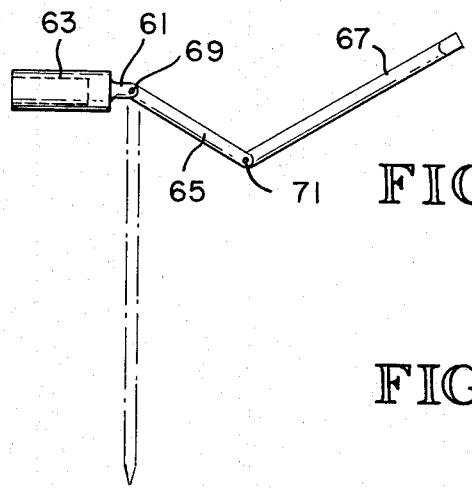
FIG. 10
FIG. 11
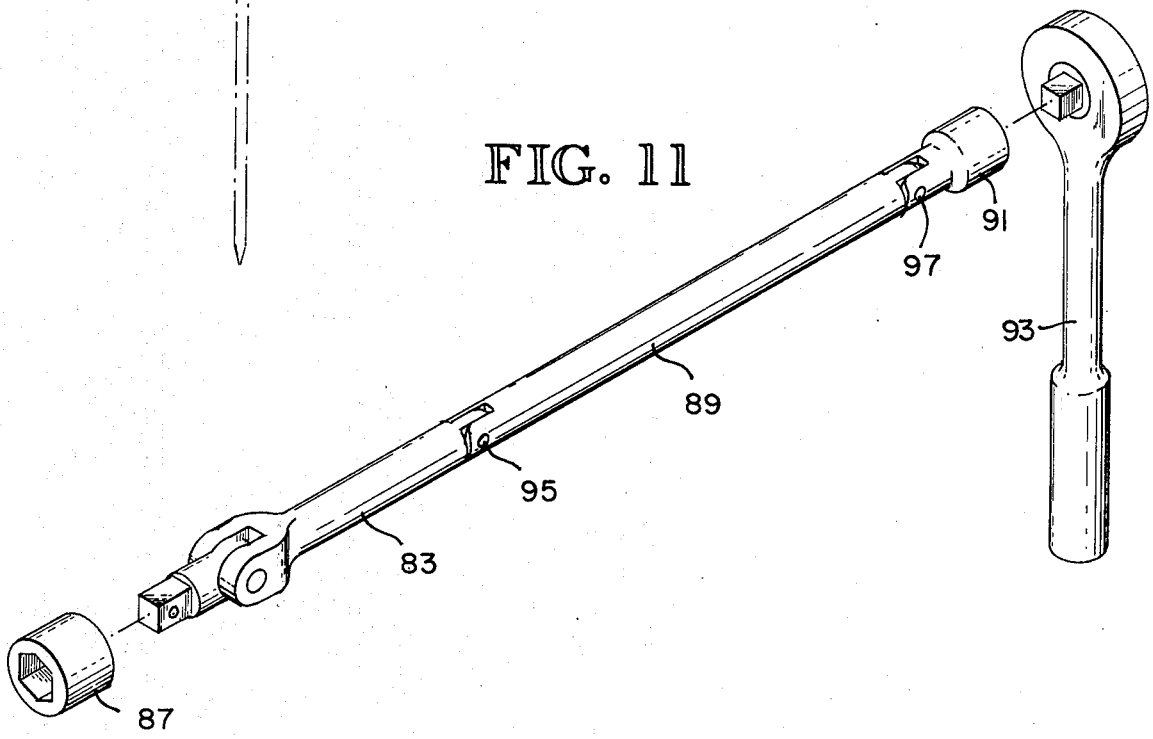
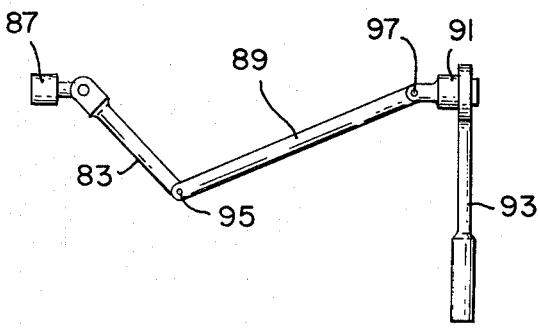
FIG. 12

Z STYLE SPEED WRENCH

This is a continuation of application Ser. No. 21,847, filed Mar. 19, 1979, now abandoned.

BACKGROUND OF THE INVENTION

This invention relates generally to the mechanical tool art and more specifically concerns a tool for driving sockets and the like wherein the tool has swivel points along its length which enables the tool to take various configurations, depending upon the torque and speed desired.

Many articles of manufacture are assembled with a large number of securing articles, such as bolts/nuts and screws. Often, the assembly of these articles, as well as their partial or complete disassembly for inspection, maintenance or repair, is a tedious and time consuming task. Examples of such articles include the rear panel on many television sets, aircraft panels and engine oil pans, all of which use a large number of the same size nut/bolt combinations or screws in their construction. Power driven tools are available for such tasks, but they are expensive, and cumbersome. Also, power may not be readily available in a particular situation. There are also specialty tools, like nut drivers, which provide some improvement, but even these tools have proven to be too slow for applications such as those mentioned above.

Thus, there is a need for a simple, relatively inexpensive, tool for rapid insertion and removal of nuts, screws and the like which is easy to use and does not require external electrical power.

Accordingly, it is a general object of the present invention to provide such a tool which overcomes one or more of the disadvantages of the prior art noted above.

It is an object of the present invention to provide such a tool which is capable of rapid removal of securing articles such as nuts and screws.

It is another object of the present invention to provide such a tool which in combination with a socket can operate both as a conventional nut driver and as a rapid nut driver.

It is an additional object of the present invention to provide such a tool which, depending on the configuration of the head or head attachment, is useful with different shaped nuts and certain types of screws.

It is a further object of the present invention to provide such a tool which is simple to operate, and can be operated by hand.

It is yet another object of the present invention to provide one embodiment of such a tool which can operate both as a wrench extension and as a speed wrench.

It is another object of the present invention to provide such a tool which has a variable speed and torque capability.

DESCRIPTION OF THE DRAWINGS

FIG. 1 shows a perspective view of one embodiment of the invention with both swivel connections in their straight-through configuration.

FIG. 2 is a perspective view of the embodiment of FIG. 1 showing both swivel connections in a 90° configuration.

FIG. 3 shows the embodiment of FIG. 1 with the rear swivel connection in a 90° configuration.

FIG. 4 shows the embodiment of FIG. 1 with the swivel connections in configurations which permit rapid rotation of the tool.

FIG. 5 shows the embodiment of FIG. 1 with the swivel connections in a configuration which results in lower speed but higher torque capability.

FIG. 6 is a perspective view of a second embodiment of the present invention, showing one swivel connection in a 90° configuration.

FIG. 7 is a perspective view of the embodiment of FIG. 6, showing both swivel connections in a 90° configuration.

FIG. 8 is a perspective view of the embodiment of FIG. 6, showing the swivel connections in a configuration for rapid rotation of the tool.

FIG. 9 is a perspective view of a third embodiment of the present invention, showing both swivel connections in a straight-through configuration.

FIG. 10 is a perspective view showing the embodiment of FIG. 9, with the swivel connections in a configuration for rapid rotation of the tool.

FIG. 11 is a perspective view of a fourth embodiment of the present invention, showing the swivel connections in a straight-through configuration.

FIG. 12 is a perspective view of the embodiment of FIG. 11, showing the swivel connections in a configuration for rapid rotation of the tool.

SUMMARY OF THE INVENTION

The present invention is a tool which in certain embodiments can be used alone or in other embodiments as an attachment for other tools. The tool includes an elongated shank having two swivel-like connections at points along its length, which divides the shank into a base section, a middle section and a head section. The head section is adapted so that it can be joined to a nut or similar article in such a manner that rotation of the head section causes a rotation of the nut. The head section may be itself configured to be joined directly to the nut or it may be configured to receive a socket or similar means which in turn may be joined to the nut. The tool is capable of being arranged into a first operative configuration in which the swivel-like connections are arranged such that the shank is substantially straight, a second operative configuration in which the swivel connections are arranged such that at least one of the sections of the shank is at an angle relative to the others, and a third operative configuration in which the swivel connections are arranged such that the sections of the shank are all at angles relative to each other.

DESCRIPTION OF THE PREFERRED EMBODIMENT

FIGS. 1 through 5 show a first embodiment of the present invention. The first embodiment is similar in appearance in one configuration (FIG. 1) to a conventional nut driver. It includes a handle 11, and an elongated shank 13, which has a head section 15 which is adapted to receive various size sockets, one of which is shown by way of example at 17. The shank 13 is removable from handle 11, as shown most clearly in FIG. 2. Shank 13 includes ears 19—19 near the rear end 21 thereof, which mate with corresponding slots 20—20 in handle 11.

Handle 11 includes a ratchet, so it rotates freely in one direction, but not the other, on shank 13, depending upon the position of select lever 23 at the end of the handle. Handle 11 is a conventional item and may be purchased as an off-the-shelf item, or through catalogs from various manufacturers.

At the front end of head section 15 of shank 13 is a square front head 25 which is adapted to receive sockets 17 of various sizes. Front head 25, however, may take other configurations, either to receive other sockets, or it may be itself configured into a socket form or other tool head, such as a hex or phillips screwdriver head.

The shank 13 of the embodiment shown in FIGS. 1–5 is circular in cross-section, approximately $\frac{3}{8}''$ in diameter and is approximately $5\frac{1}{2}$ inches long, including the portions which extend into handle 11 and socket 17. The shank may be made from a number of different materials. The material should be rigid, however, and fairly strong, such as a steel alloy.

An important part of the present invention is the swivel connections 27, 29 at two points along the length of shank 13. The swivel connections 27 and 29 are in the same plane, so that if both swivels are rotated as shown in FIG. 2, each section of the shank 13 will still be in one plane. The first swivel connection 27 is approximately 1 inch from the front end of shank 13, while the second swivel connection 29 is at a point approximately $3\frac{3}{4}$ inches from the front end of shank 13. Although the particular dimensions of the sections of the shank are not critical, it is important that the middle and base sections be sufficiently long that the tool can be arranged into the configuration of FIG. 4 and proper rotational movement of the tool, as described hereinafter, achieved.

Referring specifically now to FIG. 2, shank 13 includes a middle section 33, and a handle or base section 35, in addition to head section 15. Each end of the middle section 33 includes a longitudinal slot which in the embodiment shown extends cross-sectionally through the shank. Each slot is approximately $\frac{1}{8}''$ inch wide and $\frac{3}{8}''$ deep. The two end ears on either side of each slot, e.g. ears 30 and 32 at the junction of head section 15 and middle section 33, are rounded at their end edges.

Approximately central of each ear is located a hole approximately $\frac{1}{8}''$ in diameter which extends through both ears. In the embodiment shown, a projection from the front end of the handle section 35 and a projection from the rear end of head section 15 is adapted to fit into the respective slots of both ends of middle section 33. Each projection, e.g. projection 36, extends across the full cross-sectional dimension of the shank, and is approximately as high as its mating slot in the middle section is deep, and approximately as wide as the slots.

The top of the projection is rounded. On either side of the base of the projection and perpendicular thereto is a flat surface which extends from the projection out to the exterior surface of the shaft. Hence, when the middle section 33 is mated with the handle and head sections, the ears of each end of the middle section 33 lie adjacent the projections from the mating ends of the head and handle sections, and the rounded tops of the ears are just adjacent the flat surfaces adjacent the projections.

Completing each swivel connection is a pin 34 which extends through the two ears and a corresponding hole in the mating projection. The pins are fitted and arranged so as to permit rotation of the head and handle sections relative to the middle sections.

Within each swivel connection is a frictional stop, (not shown) which tends to hold shank 13 in a straight line configuration, as shown in FIG. 1. The stop comprises a spring loaded ball located in the bottom surface of each slot of middle section 33. The ball extends above the surface a slight distance, but can be forced down to surface level. A detent is provided in the top of each projection, which when mated with the spring loaded ball tends to hold shank 13 in the configuration of FIG. 1. In this configuration, the tool may be used as a conventional nut driver, as the shank as a whole will have sufficient longitudinal rigidity to permit the rotation of the tool by the user. The tool in such a configuration may be inserted through small openings and the like to reach a nut. Application of a small amount of force is sufficient, however, to urge the ball down, releasing the swivel connection.

FIGS. 2 through 5 show the article in various configurations. FIG. 3, for instance, shows the swivel connection 27 in a straight-through configuration and the swivel connection 29 at a 90° angle. In another arrangement (not shown) the swivel connection 29 may be straight-through, and swivel connection 27 at a 90° angle. Both are high torque configurations to be used primarily when a nut or the like is to be initially loosened or tightened.

FIGS. 2, 4 and 5 show swivel connection configurations which are generally lower torque than the arrangement of FIG. 3. FIG. 2 shows both swivel connections at 90° angles, in which configuration the tool may be used like a crank, with a fairly high torque capability, and still a somewhat low speed capability, although higher than that for FIG. 3.

FIG. 4 shows an arrangement of swivel connections which maximizes speed capability, but results in a reduction of torque capability over the configuration of FIG. 3. The arrangement of FIG. 4 is a hazy Z, with the bottom edge 38 of the handle 11 being approximately on the centerline 40 of head portion 15. In this position, the tool may be rotated at a high speed with a simple wrist action, while the arm of the operator remains substantially steady.

The fit of the swivel joints is usually sufficiently tight that when the tool is moved into the configuration of FIG. 4, it tends to remain in that configuration during rotation of the tool, as described below. This permits the operator to exert some longitudinal pressure along the tool, insuring a good joining of the tool with the article, i.e. nut, to be removed or inserted, without the tool changing configuration. Swivel connection 27 rotates in place, rotating with it the socket 17, while swivel 29 describes a circle about centerline 40. The bottom edge 38 will also remain approximately on the centerline 40. The radius of the circle described by swivel connection 29 will depend upon the relative lengths of the middle and base section and the angles of the three sections relative to each other.

With the two swivel connection tool as shown, the relative angular relationship between the handle section 35, the middle section 33 and the head section 15 may be altered over a relatively wide range, with the tool having a maximum torque capability in FIG. 3, and a maximum speed capability in FIG. 4. In terms of angular relationship, the embodiment of FIG. 3 shows one of the swivel connections at a 90° angle while the other is straight through. In FIG. 4, the angle of middle section 33 relative to centerline 40 is approximately 45° and the angle between middle section 33 and handle section 35 approximately 100°, although these angles will vary depending on the lengths of the shank sections and the handle.

FIGS. 6, 7 and 8 show a second embodiment of the article of the present invention, for use with a wrench having a conventional swivel head connection 41. The article includes a shank 42, which, like the embodiment of FIG. 1, has three sections, a head section 41, a middle section 43, and a handle or base section 45 which is secured by a spring 49 to a handle 51.

The middle section 45 and head section 41 form a portion of a conventional swivel head wrench, with head section 41 including a swivel connection 46 and a front head 44 which is adapted to receive various size sockets such as the one shown at 53 in FIG. 6. The handle section 45 and swivel connection 47, which connects handle section 45 to middle section 43 completes this embodiment. When the swivel connection 47 is straight, as shown in FIG. 6, the swivel connection 47 and the handle section 45 are hidden within handle 51. A flange 54 in the shape of a conical section is disposed around middle section 45 in a position where it abuts against the top end of handle 51 when swivel connection 47 is straight-through, thus hiding swivel connection 47 from view.

Swivel connection 47 is similar in configuration to the swivel connections of the embodiment of FIGS. 1–5, except that there is no ball and detent arrangement, because the swivel is held in the straight through configuration by the handle 51. However, spring loaded balls are positioned on the shank just below the conical section and detents are positioned on the inside of the handle 51 to prevent the shank from easily coming out of the handle 51. With application of some force, however, the handle portion 45 of shank 42 may be pulled out of the handle 51, against the action of the ball/detent and the spring 49.

The swivel connections may be arranged as shown in FIG. 6 for maximum torque to provide the initial loosening or tightening of the nut. The arrangement of FIG. 7 will permit relatively high torque with a medium speed, while the arrangement of FIG. 8, with the end edge 56 of handle 51 on approximately the centerline of front head 44 permits maximum speed of the tool. In the configuration of FIG. 8, the user can rotate the tool with a simple wrist action, similar to that shown for the arrangement of FIG. 4.

It should be understood that the principle of the present invention may be used in a variety of tools, and with a variety of different head attachments and/or configurations. For instance, the tool may be used to drive sockets or it may itself have a hex head, phillips head or an allen head configuration. Other configurations and/or attachments are possible, as long as a rotational action of the tool is required for action on the nut or the like, and there is a good connection between the nut and the tool.

FIGS. 9 through 12 show two additional embodiments which demonstrate the applicability of the principle of the present invention to other tools. FIGS. 9 and 10 show a tire iron embodiment, in which a shank 60 has a short head portion 61 which is secured to a socket 63 which is of a size appropriate for the nuts on a conventional automobile wheel. The shank 60 further includes a middle portion 65 and an end or base portion 67. The middle portion 65 is connected to the head portion 61 and end portion 67, respectively, by swivel connections 69 and 71.

Swivel connections 69 and 71 are virtually identical to swivel connections 27 and 29 of the embodiments of FIGS. 1–5. The free end 73 of end portion 67 is configured in the embodiment shown in the shape of a hub cap remover. Other configurations are possible, however. The tire iron of FIGS. 9 and 10 is a high torque tool when the swivel connection 69 is at 90° and swivel connection 71 is straight through, which is shown in dashed lines in FIG. 10. In this position, the wheel nuts may be tightened or initially loosened. Fast rotation of the nuts, in either direction, is accomplished when the shank is in the configuration shown in solid lines in FIG. 10, with the swivel connections being as shown. In such a configuration, middle section 65 is at an angle of approximately 30° from the horizontal, while there is an angle of approximately 120° between middle section 65 and end section 67. Again, as with the previous embodiments, a decrease in the angle between middle section 65 and the horizontal and a corresponding increase in the angle between middle section 65 and end section 67 results a lower torque but higher speed configuration, while the opposite will increase the torque but decrease the speed capability of the tool.

In use, the operator grasps the end portion 67 with one hand and rotates it with a simple wrist action which results in swivel connection 71 describing a circle, and the rotation of swivel connection 69 in a fixed position, resulting in rotation of socket 63. Positioned in swivel connection 69 is a stop so that middle portion 65 may move only to an angle of 45° relative to head portion 61. This permits pressure to be exerted by the user against the socket and hence against the nut along with the rotational force exerted.

FIGS. 11 and 12 show a further embodiment of the present invention. It is in the form of a conventional extension with a swivel head. The shank of the extension includes a head portion 83, with the swivel head 85, which mates with a socket or similar tool 87, a middle portion 89 and a ratchet or base portion 91, which is configured as a socket at its end to mate with the head of a ratchet 93.

The shank includes swivel connections 95 and 97. When swivel connections 95 and 97 are in their straight through configuration, the shank looks and operates like a conventional ratchet extension with a swivel head. When the two swivel connections 95 and 97 are arranged at an angle, however, as shown in FIG. 12, the apparatus may be used as a speed wrench. In use, the operator grasps the handle of ratchet 93 with one hand, grasps the middle section 89 of the shank with the other hand, and then rotates the middle section about the ratchet head, so that swivel connection 95 describes a circle but swivel connection 97 and swivel head 85 rotate in the positions shown. This results in a rapid rotation of socket 87 and removal of the nut or like article.

Thus, a new tool useful in numerous applications has been described which may in some embodiments be used alone, or in other embodiments as an attachment to known tools. The tool includes an elongated shank having a head end portion which is adapted to receive a socket or like device. Along the shank are positioned two swivel connections which permit the tool to be arranged in various configurations. In one typical configuration, one swivel connection is straight through and the other is at 90°, giving a high torque but relatively low speed capability. In another typical configuration, the swivel connections are at angles, so that the tip of the free end section is approximately on the centerline of the head portion. In this configuration, the tool has a lower torque capability but a high speed capability. The tool may be adapted in various embodiments for use in a wide variety of tool applications, some of which are shown and described above. The head portion of the tool may be adapted to receive various articles, such as a socket, or it may itself take various configurations, including a socket, and phillips, hex head, and other configurations.

Although a preferred embodiment of the invention is disclosed herein for purposes of illustration, it will be understood that various changes, modifications and substitutions may be incorporated in such embodiment without departing from the spirit of the invention as defined by the claims which follow:

What is claimed is:

1. A tool, comprising:

an elongated, articulated shank having exactly two-swivel like joints which divide said shank lengthwise into, in sequence, a head section, a middle section, and a base section, each of said sections being substantially straight and movable relative to each other in but a single plane, said head section including means permitting the joining of said head section to a nut or the like, said base section including a handle means which is rotatable relative to said base section, wherein the outermost end of said base section terminates within said handle means and wherein the combination of said base section and said handle means is substantially longer than said middle and head sections, respectively, so that, in operation, said head section, and hence the nut or similar article to which it is joined, may be rotated rapidly by revolving said handle means about a tool centerline.

2. An apparatus of claim 1 wherein the combination of said base section and said handle means is approximately twice as long as said middle section.

3. An apparatus of claim 2, wherein said swivel-like joints have a sufficiently tight fit that the tool tends to remain in its operative configuration during use of the tool after it has been initially positioned in its operative configuration.

* * * * *